US007880044B2

(12) United States Patent
Gunnerman et al.

(10) Patent No.: US 7,880,044 B2
(45) **Date of Patent: *Feb. 1, 2011**

(54) CONVERSION OF BIOGAS TO LIQUID FUELS

(76) Inventors: Rudolf W. Gunnerman, 6604 Windy Hill Way, Reno, NV (US) 89511; Peter W. Gunnerman, 2630 Lakeridge Shores West, Reno, NV (US) 89519

( * ) Notice: Subject to any disclaimer, the term of this patent is extended or adjusted under 35 U.S.C. 154(b) by 369 days.

This patent is subject to a terminal disclaimer.

(21) Appl. No.: 12/171,801

(22) Filed: Jul. 11, 2008

(65) Prior Publication Data

US 2009/0250330 A1 Oct. 8, 2009

Related U.S. Application Data

(63) Continuation-in-part of application No. 12/098,513, filed on Apr. 7, 2008.

(51) Int. Cl.
*C07C 1/00* (2006.01)
*C10L 1/04* (2006.01)

(52) U.S. Cl. ..... 585/240; 585/241; 585/639; 208/15; 208/16; 208/17; 208/142; 208/144

(58) Field of Classification Search ..... 585/240, 585/241, 639; 208/15, 16, 17, 142, 144
See application file for complete search history.

(56) References Cited

U.S. PATENT DOCUMENTS

| | | | | |
|---|---|---|---|---|
| 2,438,029 | A * | 3/1948 | Atwell | 518/712 |
| 2,852,350 | A * | 9/1958 | Kolbel et al. | 422/201 |
| 4,252,736 | A * | 2/1981 | Haag et al. | 518/702 |
| 5,728,918 | A | 3/1998 | Nay et al. | |
| 6,068,760 | A | 5/2000 | Benham et al. | |
| 6,774,149 | B1 * | 8/2004 | Gagnon | 518/721 |
| 6,822,006 | B1 * | 11/2004 | O'Rear et al. | 518/712 |
| 6,824,682 | B2 * | 11/2004 | Branson | 210/603 |
| 7,022,888 | B2 * | 4/2006 | Choudhary et al. | 585/639 |
| 7,608,439 | B2 * | 10/2009 | McTavish et al. | 435/167 |
| 2002/0035036 | A1 | 3/2002 | Figueroa et al. | |
| 2005/0027020 | A1 | 2/2005 | Steynberg | |
| 2006/0054865 | A1 | 3/2006 | Smith et al. | |
| 2006/0287560 | A1 | 12/2006 | Xie | |
| 2007/0142481 | A1 * | 6/2007 | Steynberg et al. | 518/726 |

* cited by examiner

*Primary Examiner*—N. Bhat
(74) *Attorney, Agent, or Firm*—Townsend and Townsend and Crew LLP.; M. Henry Heines

(57) ABSTRACT

Biogas is converted to a liquid fuel by passing the biogas through a liquid reaction medium that contains a petroleum fraction in the presence of a transition metal catalyst, and doing so at an elevated but non-boiling temperature.

11 Claims, No Drawings

CONVERSION OF BIOGAS TO LIQUID FUELS

CROSS-REFERENCE TO RELATED APPLICATION

This application is a continuation-in-part of U.S. patent application Ser. No. 12/098,513, filed Apr. 7, 2008, the contents of which are incorporated herein by reference in their entirety.

BACKGROUND OF THE INVENTION

1. Field of the Invention

This invention resides in the field of biogas and its use as a source of energy.

2. Description of the Prior Art

The need for and interest in alternative sources of energy is continually increasing as crude oil prices continue to rise and as public awareness and concern over the effects on the environment of gaseous emissions from the processing of crude oil continue to grow. The disposal of municipal waste is also a perennial challenge as the rate at which the waste is generated continues to increase and as traditional means of disposal of the waste are faced with rising costs and increasing ecological concerns. Sources of municipal waste include everyday items such as product packaging, furniture, clothing, bottles and other discarded containers, food scraps, newspapers, appliances, paint, and batteries, as well as biomedical waste from hospitals, granular waste such as contaminated soil, liquid waste such as cooking oils, automotive oils, shale oil, and PCB oils, agricultural waste such as grass clippings, straw, wood, leaves, and plant matter in general, and industrial waste such as coal and lignite. The traditional methods of disposal include landfill and incineration, and the gaseous emissions from incineration contribute to air pollution and global warming.

One means of deriving value from municipal waste and waste products in general without incineration is biodegradation, which is the biological breakdown of organic matter in the absence of oxygen. The product of this breakdown is known as "biogas," and the breakdown can be achieved by such processes as anaerobic digestion and fermentation of biodegradable materials such as biomass, manure, sewage, municipal waste, and energy crops. Depending on its source, biogas can include hydrogen, methane, and carbon monoxide, as well as relatively benign gases such as nitrogen and carbon dioxide.

SUMMARY OF THE INVENTION

It has now been discovered that biogas can be converted to a liquid fuel that can drive an engine or any other machinery or appliance that is typically run by a petroleum-based fuel. Conversion in accordance with this invention is achieved by passing the biogas through a liquid reaction medium that contains a petroleum fraction, and doing so at an elevated but non-boiling temperature, while contacting the reaction medium with a transition metal catalyst. The gaseous product that results from the contact contains a vapor that can be condensed to achieve the liquid fuel. The condensed product is chemically distinct from the liquid petroleum fraction, and when the process is operated on a continuous basis without adding further liquid petroleum fraction to the reaction medium, the product is produced in a volume that far exceeds the starting volume of the reaction medium.

These and other objects, advantages, and features of the invention are explained further below.

DETAILED DESCRIPTION OF THE INVENTION AND PREFERRED EMBODIMENTS

The term "biogas" is used herein to include any non-inert gas that can be produced by the biological degradation of organic matter. As noted above, prime examples of biogas are hydrogen, methane, and carbon monoxide, although other biogases that are also included within the scope of this invention are other gaseous petroleum-based products such as ethane and ethylene, as well as decomposition products of agricultural waste such as wood chips, grains, grasses, leaves, and the like. The term "biogas" is also used herein to include the same gases that are obtained from other sources. One example is methane associated with coal, commonly known as "coal bed methane," "coal mine methane," and "abandoned mine methane." Such methane can be derived by bacterial activity or by heating. Gases containing 90% to 100% methane on a mole percent basis are of particular interest, and this includes natural gas, of which methane typically constitutes approximately 95 mole percent.

The petroleum fraction in the liquid reaction medium in the process of this invention includes fossil fuels, crude oil fractions, and many of the components derived from these sources. The fossil fuels can include any carbonaceous liquid that is derived from petroleum, coal, or any other naturally occurring material, as well as processed fuels such as gas oils and products of fluid catalytic cracking units, hydrocracking units, thermal cracking units, and cokers. Included among these fuels are automotive fuels such as gasoline, diesel fuel, jet fuel, and rocket fuel, as well as petroleum residuum-based fuel oils including bunker fuels and residual fuels. Fractions or products in the diesel range can also be used, such as straight-run diesel fuel, feed-rack diesel fuel (as commercially available to consumers at gasoline stations), light cycle oil, and blends of straight-run diesel and light cycle oil. Crude oil fractions include any of the various refinery products produced from crude oil, either by atmospheric distillation or by vacuum distillation, as well as fractions that have been treated by hydrocracking, catalytic cracking, thermal cracking, or coking, and those that have been desulfurized. Examples of such fractions are light straight-run naphtha, heavy straight-run naphtha, light steam-cracked naphtha, light thermally cracked naphtha, light catalytically cracked naphtha, heavy thermally cracked naphtha, reformed naphtha, alkylate naphtha, kerosene, hydrotreated kerosene, gasoline and light straight-run gasoline, straight-run diesel, atmospheric gas oil, light vacuum gas oil, heavy vacuum gas oil, residuum, vacuum residuum, light coker gasoline, coker distillate, FCC (fluid catalytic cracker) cycle oil, and FCC slurry oil. Preferred reaction media are mineral oil, diesel oil, naphtha, kerosene, gas oil, and gasoline.

The transition metal catalyst can be any single transition metal or combination of transition metals, either as metal salts, pure metals, or metal alloys, and can also be used in combination with metals other than transition metals. Preferred catalysts for use in this invention are metals and metal alloys. Transition metals having atomic numbers ranging from 23 to 79 are preferred, and those with atomic numbers ranging from 24 to 74 are more preferred. Cobalt, nickel, tungsten, and iron, particularly in combination, are the most preferred. An example of an additional metal that can be included is aluminum.

The metallic catalyst is used in solid form and is preferably maintained below the liquid level in the reaction medium as the biogas is bubbled through the liquid. The metal(s) can assume the form of pellets, granules, wires, mesh screens, perforated plates, rods, or strips. Granules and wires suspended across plates or between mesh matrices such as steel or iron wool are preferred for their relatively accessible high surface area. When granules are used, the granules can be maintained in a fluidized state in the reaction medium or held stationary in the form of a fixed bed. When wires are used, individual cobalt, nickel, aluminum, and tungsten wires, for example, of approximately equal diameter and length, and be strung across a frame of cast iron to form an open-mesh network which can then be supported inside the reactor. A reactor can contain a single frame strung with wires in this manner or two or more such frames, depending on the size of the reactor. Catalyst of the same or similar composition can also be placed in the product vapor line emerging from the reactor, to increase the conversion rate of the system.

The process is performed under non-boiling conditions to maintain the reaction medium in a liquid state. An elevated temperature, i.e., one above ambient temperature, is used, preferably one that is about 100° C. or above, more preferably one within the range of about 100° C. to about 250° C., and most preferably from about 150° C. to about 200° C. The operating pressure can vary as well, and can be either atmospheric, below atmospheric, or above atmospheric. The process is readily and most conveniently performed at either atmospheric pressure or a pressure moderately above atmospheric. Preferred operating pressures are those within the range of 1 atmosphere to 2 atmospheres.

iron), nickel wire, tungsten wire, and cast iron granules. The material was placed in a reaction vessel over a perforated aluminum plate, and the vessel was charged with heavy mineral oil, submerging the catalyst material. The vessel contents were then heated to approximately 320-370° F. (approximately 160-190° C.), and hydrogen gas was bubbled through the vessel at a continuous rate of 60-80 cubic feet per hour (measured at ambient temperature of approximately 25° C.), while the pressure in the reactor was maintained at or below 2 psig (approximately 115 KPa). The reaction was continued for five hours, after which time the reaction medium had reduced in volume from 3 parts by volume to 2 parts by volume, and had produced 2.5 parts by volume of condensed product. Values of the kinematic viscosity (taken at 50° C. using the protocol of ASTM D 445), flashpoint (by the Pensky-Martens closed-cup method using the protocol of ASTM D 93a), hydrocarbon composition (using the Robinson Modified Method of ASTM D 3239-2425), lubricity (using the high-frequency reciprocating rig method at 60° C. with the protocol of ASTM D 6049), vapor pressure (using the dry vapor pressure equivalent method with the protocol of ASTM D 5191), and gross heat of combustion (measured according to the protocol of ASTM D 240) were taken on the reaction medium at the start of the test (mineral oil) and at one and five hours after the start of the test, and on the condensed gaseous product at one and five hours after the start of the test. The results are listed in Table I below.

TABLE I

Test Results for Hydrogen and Mineral Oil

| | Reaction Medium | | | Condensed Product | |
|---|---|---|---|---|---|
| | Start of Test | at 1 hour | at 5 hours | at 1 hour | at 5 hours |
| Kinematic Viscosity (centistokes) | 4.524 | 15.27 | 4.506 | 4.499 | 4.512 |
| Flashpoint (° C.) | 126.5 | 151.5 | 168 | 74 | 132 |
| Hydrocarbon Composition (% by weight): | | | | | |
| Total Paraffins | 25.01 | 29.97 | 34.46 | 22.24 | 21.7 |
| Naphthenes | 60.59 | 59.63 | 59.74 | 59.86 | 63.7 |
| Aromatics | 14.4 | 10.4 | 5.8 | 17.9 | 14.6 |
| Lubricity (mm) | 0.15 | 0.24 | 0.16 | 0.33 | 0.3 |
| Vapor Pressure (psi) | 0.25 | 0.25 | 0.25 | 1.06 | 0.48 |
| Gross Heat of Combustion (BTU/lb) | 19,572 | 19,577 | 19,536 | 19,505 | 19,693 |

The following examples are offered for purposes of illustration only.

Example 1

This example illustrates the use of the present invention in a processing system in which the biogas is hydrogen and the reaction medium is mineral oil.

A catalyst material was prepared by placing the following between two pads of steel wool: aluminum wire, cobalt wire (an alloy containing approximately 50% cobalt, 10% nickel, 20% chromium, 15% tungsten, 1.5% manganese, and 2.5%

The product was fed to a VAL6 Infrared Oil Heater (Shizuoka Seiki Co., Ltd., Japan) where it burned readily in air. An attempt to use the liquid reaction medium at the start of the test (mineral oil) in the same oil heater was made, and the result was negative, i.e., the medium would not burn.

Example 2

This example illustrates the use of the present invention in a processing system in which the biogas is methane and the reaction medium is mineral oil. Except for the substitution of methane for hydrogen, the test was conducted in the same manner as that of Example 1, using the same materials and operating conditions. The results, measured as in Example 1, are listed in Table II below.

TABLE II

Test Results for Methane and Mineral Oil

| | Reaction Medium | | | Condensed Product | |
|---|---|---|---|---|---|
| | Start of Test | at 1 hour | at 5 hours | at 1 hour | at 5 hours |
| Kinematic Viscosity (centistokes) | 4.524 | 15.11 | 26.79 | 4.201 | 5.967 |
| Flashpoint (° C.) | 126.5 | 157 | 172.5 | 115 | 253.5 |
| Hydrocarbon Composition (% by weight): | | | | | |
| Total Paraffins | 25.01 | 31.12 | 36.6 | 18.87 | 23.13 |
| Naphthenes | 60.59 | 59.08 | 63 | 64.83 | 63.57 |
| Aromatics | 14.4 | 9.8 | 0.4 | 16.3 | 13.3 |
| Lubricity (mm) | 0.15 | 0.23 | 0.19 | 0.34 | 0.16 |
| Vapor Pressure (psi) | 0.25 | 0.25 | 0.25 | 0.25 | 0.25 |

The product was fed to a VAL6 Infrared Oil Heater (Shizuoka Seiki Co., Ltd., Japan) where it burned readily in air. As in Example 1, the liquid reaction medium at the start of the test (mineral oil) would not burn in the same oil heater.

Example 3

This example illustrates the use of the present invention in a processing system in which the biogas is 50% hydrogen and 50% carbon monoxide (by volume) and the reaction medium is mineral oil. Except for the substitution of the hydrogen/carbon monoxide mixture, the test was conducted in the same manner as that of Example 1, using the same materials and operating conditions. The results, measured as in Example 1, are listed in Table III below.

TABLE III

Test Results for Hydrogen/Carbon Monoxide and Mineral Oil

| | Reaction Medium | | | Condensed Product | |
|---|---|---|---|---|---|
| | Start of Test | at 1 hour | at 5 hours | at 1 hour | at 5 hours |
| Kinematic Viscosity (centistokes) | 4.524 | 16.84 | 57.37 | 4.274 | 5.797 |
| Flashpoint (° C.) | 126.5 | 327.5 | 0 | 141 | 126.5 |
| Hydrocarbon Composition (% by weight): | | | | | |
| Total Paraffins | 25.01 | 25.51 | 32.01 | 17.95 | 21.63 |
| Naphthenes | 60.59 | 63.49 | 67.89 | 65.35 | 63.87 |
| Aromatics | 14.4 | 11 | 0.1 | 16.7 | 14.5 |
| Lubricity (mm) | 0.15 | 0.18 | 0.17 | 0.24 | 0.14 |
| Vapor Pressure (psi) | 0.25 | 0.25 | 0.25 | 0.25 | 0.25 |

The product was fed to a VAL6 Infrared Oil Heater (Shizuoka Seiki Co., Ltd., Japan) where it burned readily in air. As in Examples 1 and 2, the liquid reaction medium at the start of the test (mineral oil) would not burn in the same oil heater.

Example 4

This example illustrates the use of the present invention in a processing system in which the biogas is methane and the reaction medium is diesel. The catalyst was the same as that described above in Example 1, and the reaction vessel was 19 inches (0.5 meter) in diameter and initially charged with ten gallons (39 liters) of diesel. The diesel in the reactor was heated to 240° F. (116° C.) and maintained at a pressure of 3 psig (122 kPa) as methane was bubbled through the reactor. Product gas was drawn from the reactor and condensed to form a clear, colorless liquid, with uncondensed has recycled to the reactor. The reactor was allowed to run for ten hours before a product sample was collected for testing. After the initial ten hours, the reaction was continued for another 2.5 hours as a product sample was collected. The volume of the product sample collected during the 2.5 hours was 5.6 liters, after which the volume of the reaction medium remained at 8-10 gallons (30-39 liters). The characteristics of the product were analyzed by standard ASTM protocols and are listed in Table IV below.

TABLE IV

Test Results for Methane and Diesel

| | Protocol | Result | |
|---|---|---|---|
| API Gravity at 60° F. (15.6° C.) | ASTM D 287 | 34.8° | |
| | | Percent Recovered: | Result |
| Distillation at 760 mm Hg (1 atm) | ASTM D 86 | Initial b.p. | 423° F. |
| | | 5 | 452.5° F. |
| | | 10 | 464.7° F. |
| | | 20 | 475.5° F. |
| | | 30 | 485.4° F. |
| | | 40 | 495.1° F. |
| | | 50 | 505.2° F. |
| | | 60 | 516.0° F. |
| | | 70 | 527.5° F. |
| | | 80 | 541.6° F. |
| | | 90 | 560.8° F. |
| | | 95 | 580.3° F. |
| | | End | 597.9° F. |
| | | Recovery | 98.1% |
| | | Residue | 1.0% |
| | | Loss | 0.9% |
| | | Pressure | 765 mm Hg |
| Estimated hydrogen content | ASTM D 3343 | 13.38 | weight % |
| Particulate Matter | ASTM D 2276 | 2-0.8 μm filters | 8.5 mg/gal |
| | | Volume | 0.26 gal |
| | | Vacuum | 28.3 in. Hg |
| | | Time | 10 min |
| Total Aromatics | ASTM D 1319 | 18.0 | volume % |
| Sediment and Water | ASTM D 2709 | 0 | volume % |
| Ash | ASTM D 482 | 0.002 | weight % |
| Copper Corrosion (3 hours at 122° F., 50° C.) | ASTM D 130 | 1a | |
| Ramsbottom Carbon Residue | ASTM D 524 | 0.07 | weight % |
| Lead | ASTM D 3605 | <0.1 | ppm |
| Vanadium | ASTM D 3605 | <0.1 | ppm |
| Calcium | ASTM D 3605 | <0.1 | ppm |
| Sodium, Potassium, Lithium | ASTM D 3605 | <0.1 | ppm |
| Demulsification | ASTM D 1401 | 5 | minutes |
| Sulfur by X-ray | ASTM D 2622 | 0.0005 | weight % |
| Flash Point | ASTM D 93 | 202° F. (94° C.) | |
| Gross Heat of Combustion | ASTM D 240 | 19,547 | BTU/lb, |
| | | 138,490 | BTU/gal |

The product was fed to a VAL6 Infrared Oil Heater (Shizuoka Seiki Co., Ltd., Japan) where it burned readily in air, emitting neither odor nor smoke.

In the claims appended hereto, the term "a" or "an" is intended to mean "one or more." The term "comprise" and variations thereof such as "comprises" and "comprising," when preceding the recitation of a step or an element, are intended to mean that the addition of further steps or elements is optional and not excluded. All patents, patent applications, and other published reference materials cited in this specification are hereby incorporated herein by reference in their entirety. Any discrepancy between any reference material cited herein and an explicit teaching of this specification is intended to be resolved in favor of the teaching in this specification. This includes any discrepancy between an art-understood definition of a word or phrase and a definition explicitly provided in this specification of the same word or phrase.

What is claimed is:

1. A process for producing liquid fuel from a biogas comprising from 90 mole % to 100 mole % methane, said process comprising:

(a) passing said biogas through a liquid petroleum fraction at a temperature of about 100° C. or above but below boiling, while contacting said biogas and said liquid petroleum fraction with a transition metal to produce a gaseous effluent; and (b) condensing said effluent to liquid form.

2. The process of claim 1 wherein said transition metal is a metal with an atomic number from 23 to 79.

3. The process of claim 1 wherein said transition metal is a metal with an atomic number from 24 to 74.

4. The process of claim 1 wherein step (a) is performed while contacting said biogas and said liquid petroleum fraction with a plurality of transition metals in metallic form.

5. The process of claim 4 wherein said transition metals comprise cobalt, nickel, and tungsten.

6. The process of claim 4 wherein said transition metals comprise cobalt, nickel, tungsten, and iron.

7. The process of claim 1 wherein said liquid petroleum fraction is a member selected from the group consisting of mineral oil, diesel oil, naphtha, kerosene, gas oil, and gasoline.

8. The process of claim 1 wherein step (a) is performed at a temperature of from about 100° C. to about 250° C.

9. The process of claim 1 wherein step (a) is performed at a temperature of from about 150° C. to about 200° C.

10. The process of claim 1 wherein step (a) is performed at a pressure of from about 1 atmosphere to about 2 atmospheres.

11. The process of claim 1 wherein said biogas is natural gas.

* * * * *